US009027324B2

(12) United States Patent
Snyder

(10) Patent No.: US 9,027,324 B2
(45) Date of Patent: May 12, 2015

(54) ENGINE AND COMBUSTION SYSTEM

(75) Inventor: Philip H. Snyder, Avon, IN (US)

(73) Assignee: Rolls-Royce North American Technologies, Inc., Indianapolis, IN (US)

( * ) Notice: Subject to any disclaimer, the term of this patent is extended or adjusted under 35 U.S.C. 154(b) by 638 days.

(21) Appl. No.: 13/337,083

(22) Filed: Dec. 24, 2011

(65) Prior Publication Data

US 2012/0216504 A1 Aug. 30, 2012

Related U.S. Application Data

(60) Provisional application No. 61/427,584, filed on Dec. 28, 2010.

(51) Int. Cl.

| | |
|---|---|
| ***F23R 7/00*** | (2006.01) |
| ***F23M 9/06*** | (2006.01) |
| ***F23R 3/00*** | (2006.01) |
| ***F23R 3/16*** | (2006.01) |
| ***F23R 3/42*** | (2006.01) |

(52) U.S. Cl.

CPC .. *F23R 7/00* (2013.01); *F23M 9/06* (2013.01); *F23R 3/002* (2013.01); *F23R 3/16* (2013.01); *F23R 3/42* (2013.01)

(58) Field of Classification Search

CPC ..... F23R 7/00; F23R 3/16; F23R 3/42; F23R 3/002; F02C 5/00; F02C 5/12; F02K 7/02; F02K 7/04; F02K 7/06

USPC ..... 60/247, 39.38, 39.76, 39.77; 431/1

See application file for complete search history.

(56) References Cited

U.S. PATENT DOCUMENTS

| | | | | |
|---|---|---|---|---|
| 3,315,468 | A * | 4/1967 | Vdoviak | 60/749 |
| 5,203,796 | A | 4/1993 | Washam et al. | |
| 5,494,438 | A | 2/1996 | Yang | |
| 6,877,310 | B2 * | 4/2005 | Leyva | 60/247 |
| 7,137,243 | B2 * | 11/2006 | Snyder et al. | 60/247 |
| 2006/0112672 | A1 | 6/2006 | Razzell et al. | |
| 2006/0254254 | A1 | 11/2006 | Saddoughi et al. | |
| 2007/0144179 | A1 * | 6/2007 | Pinard et al. | 60/776 |
| 2007/0180810 | A1 | 8/2007 | Chapin et al. | |
| 2007/0180811 | A1 | 8/2007 | Rasheed et al. | |
| 2007/0180815 | A1 | 8/2007 | Tangirala et al. | |
| 2007/0245712 | A1 | 10/2007 | Shimo et al. | |
| 2012/0047873 | A1 * | 3/2012 | Gutmark et al. | 60/247 |

OTHER PUBLICATIONS

International Search Report and Written Opinion, PCT/US2011/067373, Rolls-Royce North American Technologies, Inc., Apr. 24, 2012.

Wintenberger, et al., Analytical Model for the Impulse of Single-Cycle Pulse Detonation Tube, Journal of Propulsion and Power, vol. 19, No. 1, Jan.-Feb. 2003 (17 pages).

Frolov, et al., Detonation Initiaton by Controlled Triggering of Electric Discharges, Jounal of Populsion and Power, vol. 19, No. 4, Jul.-Aug. 2003 (8 pages).

* cited by examiner

*Primary Examiner* — William H Rodriguez
*Assistant Examiner* — Steven Sutherland
(74) *Attorney, Agent, or Firm* — Krieg DeVault LLP

(57) ABSTRACT

One embodiment of the present invention is an engine. Another embodiment is a unique combustion system. Other embodiments include apparatuses, systems, devices, hardware, methods, and combinations for engines and combustion systems. Further embodiments, forms, features, aspects, benefits, and advantages of the present application will become apparent from the description and figures provided herewith.

20 Claims, 3 Drawing Sheets

ENGINE AND COMBUSTION SYSTEM

CROSS REFERENCE TO RELATED APPLICATIONS

The present application claims benefit of U.S. Provisional Patent Application No. 61/427,584, filed Dec. 28, 2010, entitled Engine And Combustion System, which is incorporated herein by reference.

FIELD OF THE INVENTION

The present invention relates to engines and combustion systems for engines.

BACKGROUND

Engines and combustion systems remain an area of interest. Some existing systems have various shortcomings, drawbacks, and disadvantages relative to certain applications. Accordingly, there remains a need for further contributions in this area of technology.

SUMMARY

One embodiment of the present invention is an engine. Another embodiment is a unique combustion system. Other embodiments include apparatuses, systems, devices, hardware, methods, and combinations for engines and combustion systems. Further embodiments, forms, features, aspects, benefits, and advantages of the present application will become apparent from the description and figures provided herewith.

BRIEF DESCRIPTION OF THE DRAWINGS

The description herein makes reference to the accompanying drawings wherein like reference numerals refer to like parts throughout the several views, and wherein.

DETAILED DESCRIPTION

Figure 1:
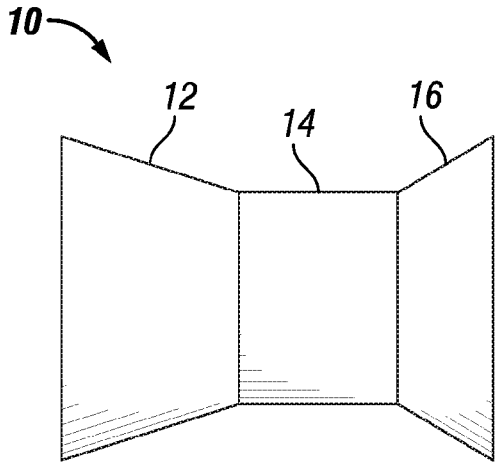
FIG. 1 schematically depicts a non-limiting example of a gas turbine engine in accordance with an embodiment of the present invention.

For purposes of promoting an understanding of the principles of the invention, reference will now be made to the embodiments illustrated in the drawings, and specific language will be used to describe the same. It will nonetheless be understood that no limitation of the scope of the invention is intended by the illustration and description of certain embodiments of the invention. In addition, any alterations and/or modifications of the illustrated and/or described embodiment(s) are contemplated as being within the scope of the present invention. Further, any other applications of the principles of the invention, as illustrated and/or described herein, as would normally occur to one skilled in the art to which the invention pertains, are contemplated as being within the scope of the present invention.

Referring to the drawings, and in particular FIG. 1, a non-limiting example of an engine 10 in accordance with an embodiment of the present invention is depicted. In one form, engine 10 is a gas turbine engine configured as an air vehicle propulsion power plant. In other embodiments, engine 10 may be another type of gas turbine engine, e.g., an aircraft auxiliary power unit, a land-based engine or a marine engine. In one form, gas turbine engine 10 is a turbofan. In other embodiments, gas turbine engine 10 may be a single-spool or multi-spool turbofan, turboshaft, turbojet, turboprop gas turbine or combined cycle engine. In still other embodiments, engine 10 may be a wave rotor engine and/or a pulse detonation engine.

In one form, engine 10 includes a compressor system 12, a combustion system 14 and a turbine system 16. Combustion system 14 is fluidly disposed between compressor system 12 and turbine system 16. During the operation of gas turbine engine 10, air is drawn into the inlet of compressor system, pressurized and discharged into combustion system 14. Fuel is mixed with the pressurized air in combustion system 14, which is then combusted. The combustion products are directed into turbine system, which extracts energy in the form of mechanical shaft power to drive compressor system 12. The hot gases exiting turbine system 20 are directed into a nozzle (not shown), and provide a thrust output of gas turbine engine 10.

In one form, combustion system 14 is a wave rotor combustion system 12, or a constant volume combustor. In other embodiments, combustion system 14 may be one or more pulse detonation combustors or a wave rotor employing pulse detonation combustors. In still other embodiments, combustion system 14 may be or may employ other types of combustors in addition to or in place of a wave rotor and/or pulse detonation combustors. In still other embodiments, combustion system 14 may be a wave rotor combustor or another type of combustor employing pulse deflagrative combustion.

Figure 2A:
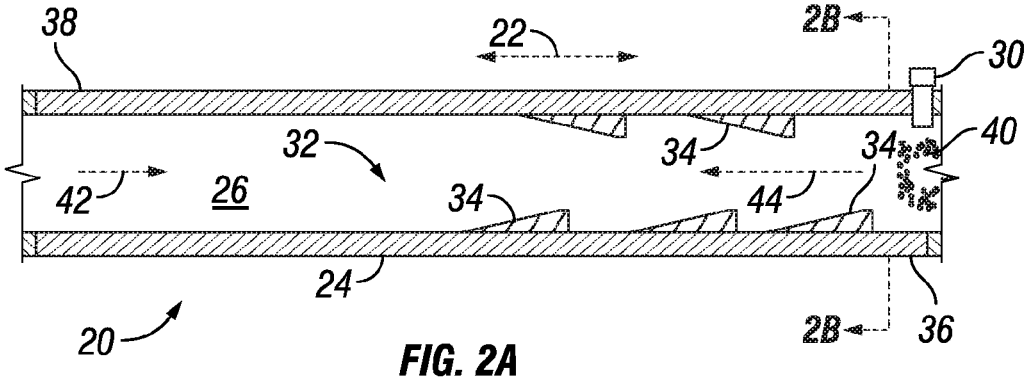
FIGS. 2A and 2B schematically illustrate a non-limiting example of aspects of a combustion system in accordance with an embodiment of the present invention.
Figure 2B:
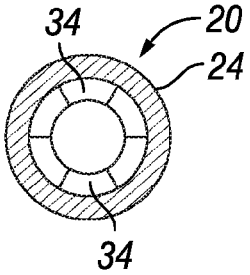
Figure 3A:
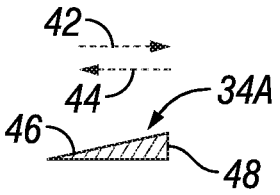
FIGS. 3A-3E schematically illustrate non-limiting examples of shapes of discrete roughness elements in accordance with some embodiments of the present invention.
Figure 3B:
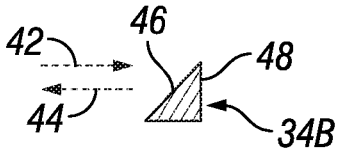
Figure 3C:
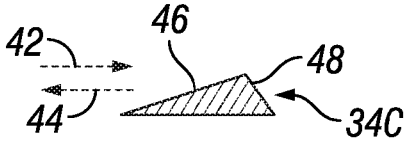
Figure 3D:
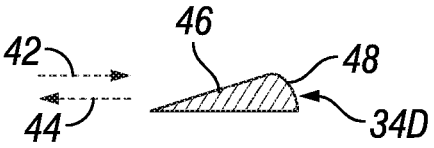
Figure 3E:
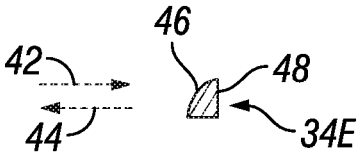

Referring to FIGS. 2A and 2B, a non-limiting example of some aspects of combustion system 14 are depicted. In one form, combustion system 14 is combined with turbomachinery (e.g., compressor system 12 and turbine system 16) to form a hybrid turbine engine. In other embodiments, combustion system 14 may be a direct propulsion engine. In various embodiments, combustion system 14 includes one or more combustion channels 20. For example, in the form of a wave rotor, combustion system 14 includes a plurality of combustion channels 20. In the form of a pulse detonation combustor and/or a pulse deflagration combustor, combustion system 14 may have a single combustion channel 20 or a plurality of combustion channels 20. Combustion channel 20 may be rotating, or may be stationary. In some embodiments, combustion system 14 may be a wave rotor having a plurality of pulse detonation combustors and/or pulse deflagration combustors, each having one or more combustion channels 20.

In one form, combustion channel 20 is an elongated tubular form. In other embodiments, combustion channel 20 may take other forms. In one form, combustion channel 20 has a circular cross-sectional shape, e.g., as depicted in FIG. 2A. The cross-sectional shape of combustion channel 20 may vary with the application. In other embodiments, combustion channel 20 may have other cross-sectional shapes, such as circular, rectangular or other N-gon, or any desired shape. In one form, combustion channel 20 is an axial combustion channel, extending predominantly in an axial direction 22 that is parallel to the axis of rotation of compressor system 12 and turbine system 16. In other embodiments, combustion channel 20 extends in any one or more of engine 10 and/or combustion system 14 radial, axial and circumferential directions.

In one form, combustion channel 20 includes a wall 24 that defines a combustion chamber 26 extending though combustion channel 20. In other embodiments, e.g., having non-circular cross-sections, combustion channel 20 may include a plurality of walls 24, e.g., N walls for an N-gon shaped combustion channel 20, which define combustion chamber 26. Wall 24 may be devoted to a single combustion channel 20, or may be a joint wall used by more than one combustion channel 20, e.g., as in a wave rotor. In one form, combustion chamber 26 is linear, extending linearly along axial direction 22. In other embodiments, combustion chamber 26 may be linear, curved, segmented, or have any shape and configuration suited to the particular application for which combustion system 14 is intended.

In one form, combustion chamber 26 is configured to contain a transient pulse combustion event. In one form, the transient pulse combustion event is one in a series of combustion events contained within combustion chamber 26, e.g., a repeating cycle of transient pulse combustion events. In other embodiments, combustion chamber 26 may be configured to contain a plurality of transient pulse combustion events, e.g., spaced apart along the length of combustion chamber 26 and occurring at the same time and/or different times, and/or to contain a continuous combustion event.

Combustion system 14 includes an ignition source 30 and a flame accelerator 32. In one form, ignition source 30 is disposed within combustion channel 20, in particular, inside combustion chamber 26. In other embodiments, ignition source 30 may be disposed adjacent to combustion channel 20 and/or combustion chamber 26, rather than being disposed within combustion channel 20 and combustion chamber 26. In one form, ignition source 30 is an igniter, such as a spark plug. In other embodiments, ignition source 30 may take another form, e.g., a high energy ignition system, or one or more ports for injecting one or more fluids to initiate a combustion event or for injecting a mixture that is already in a state of combustion.

In one form, a single ignition source 30 is employed for each combustion channel 20. In other embodiments, a plurality of ignition sources may be employed for each combustion channel 20. In still other embodiments, no ignition source may be employed for combustion channel 20. In one form, ignition source 30 is disposed at an exit end 36 of combustion channel 20. In other embodiments, ignition source 30 is disposed at an inlet end 38 of combustion channel 20. In still other embodiments, ignition source 30 may be disposed at any convenient location, including in, on or adjacent to combustion channel 20, or remote from combustion channel 20.

During operation, fuel and oxidizer are supplied to inlet end 38 of combustion channel 20 in a filling phase. The fuel and oxidizer are subsequently ignited by ignition source 30 to initiate a transient pulse combustion event 40. The combustion products resulting from transient pulse combustion event 40 are then exhausted from combustion channel 20. The mass flows of fuel, oxidizer and combustion products in the filling and exhausting processes within combustion channel 20 are in a predominant flow direction 42, from inlet end 38 toward the exit end 36 of combustion channel 20. Transient pulse combustion event 40 yields a front, e.g., a flame front and a compression wave, that travels in a combustion direction 44, which is opposite to predominant flow direction 42. An opposing front may proceed in the opposite direction.

Flame accelerator 32 is disposed in combustion channel 20, and is configured to accelerate the combustion process. In one form, flame accelerator 32 is structured to transition the combustion process from deflagration combustion to detonation combustion, e.g., to initiate a deflagration-to-detonation transition. In other embodiments, flame accelerator 32 may be configured to accelerate the combustion process, but without transitioning the combustion process from deflagration combustion to detonation combustion. In addition, flame accelerator 32 is configured to yield a directionally-dependent pressure loss in flow inside combustion channel 20. In one form, the directionally-dependent pressure loss yields a higher pressure loss in direction 44 than in direction 42. In other embodiments, flame accelerator 32 may be configured to yield a higher pressure loss in direction 42 than in direction 44.

In one form, flame accelerator 32 includes a plurality of discrete obstacles, otherwise referred to herein as discrete roughness elements 34. Each discrete roughness element is configured to accelerate the combustion process. In one form, each discrete roughness element 34 is configured to yield a greater flow contraction in one direction than the opposite direction. In other embodiments, other means of accelerating the combustion process may be employed. In one form, each discrete roughness element 34 has a shape configured to yield a directionally-dependent pressure loss in a flow through combustion channel 20.

In one form, it is the plurality of discrete roughness elements 34 that provide the directionally-dependent pressure loss of flame accelerator 32, and that accelerate the combustion process. In other embodiments, other means may be employed to yield a directionally dependent pressure loss and accelerate the combustion process in addition to or in place of discrete roughness elements 34, e.g., fluid injection ports that inject gases or liquids in a direction that has a component in direction 42 that is greater than any component in direction 44. In addition, in other embodiments, other discrete roughness elements or other means for creating a pressure loss that is/are not directionally-dependent may be employed in conjunction with directionally-dependent discrete roughness element(s) 34 or other means for yielding a directionally-dependent pressure loss.

The number of discrete roughness elements 34 may vary with the application. For example, in various embodiments, only a single discrete roughness element 34 may be employed, or a larger number of discrete roughness elements 34 may be employed. The number of discrete roughness elements in any particular embodiment depends on various factors, for example and without limitation, the desired degree of flame acceleration, the passage dimensions, the size and shape of the elements such that there is the creation of regions of pressure wave reflection into regions of flame front arrival, the creation of regions of intense mixing between combusting and yet to combust fluid, and other means to promote the rapid creation of regions of intense combustion. Discrete roughness elements 34 may take a variety of forms, e.g., including different shapes. In one form, one or more discrete roughness elements 34 are obstacles that are disposed in combustion chamber 26. In another form, one or more discrete roughness elements 34 are cavities in wall 24. Various embodiments may include discrete roughness elements 34 in the form of obstacles and/or cavities.

In one form, one or more of discrete roughness elements 34 are formed integrally with wall 24 and extend therefrom into combustion chamber 26. In other embodiments, one or more of discrete roughness elements 34 may be coupled to wall 24 and extend therefrom into combustion chamber 26, in addition to or in place of one or more discrete roughness elements 34 formed integrally with wall 24. In one form, one or more of discrete roughness elements 34 extends partially into combustion chamber 26. In some embodiments, one or more of discrete roughness elements 34 may extend from wall 24 all the way through combustion chamber 26 to an adjacent and/or opposite wall 24 or portion thereof. In one form, discrete roughness elements 34 are arranged in a staggered relationship around combustion chamber 26. In other embodiments, discrete roughness elements 34 may be arranged in a spiral and/or a ring in addition to or in place of a staggered relationship. In one form, discrete roughness elements 34 extend partially around the periphery of combustion chamber 26. In other embodiments, discrete roughness elements 34 may extend around the entire perimeter of combustion chamber 26, e.g., forming a ring or spiral, in addition to or in place of discrete roughness elements 34 that extend partially around the periphery of combustion chamber 26.

In one form, one or more discrete roughness elements 34 are configured to yield a higher flow area contraction per unit length in the combustion direction than the flow area contraction per unit length in the predominant flow direction. The flow area contraction per unit length is a measure of the suddenness or gradualness of the contraction. In one form, one or more discrete roughness elements 34 are configured to yield a sudden contraction in combustion direction 44, and a gradual contraction in predominant flow direction 42, e.g., as depicted in FIG. 2A. In other embodiments, one or more discrete roughness element 34 may be configured to yield a higher flow area contraction per unit length in the predominant flow direction than the flow area contraction per unit length in the combustion direction. In some embodiments, a sudden area change may be employed for certain area ratios (A/A), for example and without limitation, a flow area downstream divided by a flow area upstream having a value from about 0.01 to 0.2 for contracting flows, and a flow area downstream divided by a flow area upstream having a value near about 0.8 for expanding flows. In general the shape of the elements is selected to create greater drag to flow in direction 44 than in direction 42 by either or both boundary layer drag or form drag.

Referring to FIGS. 3A-3E, some non-limiting examples of shapes for discrete roughness element 34 include, but are not limited to, those shapes depicted for discrete roughness elements 34A-34E. The shape of each discrete roughness element 34 may vary with the needs of the application, and is not limited to the depictions of FIGS. 3A-3E. In one form, each discrete roughness element 34 in combustion channel 20 has the same shape. In other embodiments, a plurality of different shapes may be employed in combustion channel 20, e.g., one or more shapes illustrated in FIGS. 3A-3E and/or other shapes. In one form, discrete roughness elements 34A-34E are obstacles disposed in combustion chamber 26. In one form, each of discrete roughness element 34A-34E is configured with a flow surface 46 and a flow surface 48. Flow surface 46 is configured to provide a more gradual flow area contraction in predominant flow direction 42 than the less gradual flow area contraction in combustion direction 44 provided by flow surface 48, to yield a higher pressure drop in flow in combustion direction 44 than the pressure drop in flow in predominant flow direction 42. The degree of flow area contraction per unit length of each of flow surfaces 46 and 48 may vary with the needs of the application. Flow surfaces 46 and 48 may be planar or may be three-dimensional surfaces. In various embodiments, other shapes and/or types of discrete roughness elements 34 and/or other means of providing a directionally-dependent pressure loss may be employed in addition to or in place of discrete roughness elements 34A-34E.

Figure 4A:
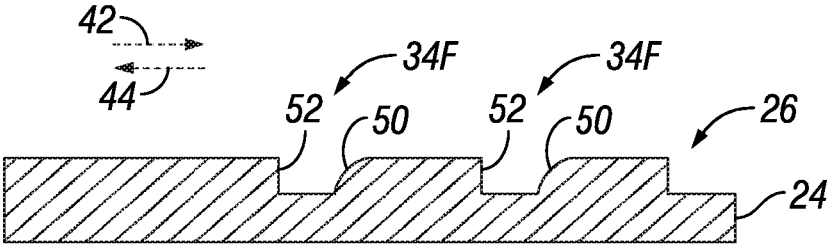
FIGS. 4A and 4B schematically illustrate non-limiting examples of discrete roughness elements in accordance with some embodiments of the present invention.
Figure 4B:
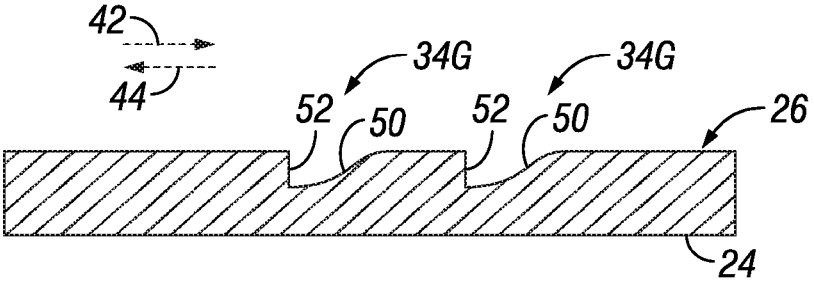

Referring to FIGS. 4A and 4B, some non-limiting examples of shapes for discrete roughness element 34 include, but are not limited to, those shapes depicted for discrete roughness elements 34F and 34G. In one form, discrete roughness elements 34F and 34G are cavities disposed in wall 24, which are exposed to combustion chamber 26. The shape of each discrete roughness element 34 may vary with the needs of the application, and is not limited to the depictions of FIGS. 4A and 4B. In one form, each discrete roughness element 34 in combustion channel 20 has the same shape. In other embodiments, a plurality of different shapes may be employed in combustion channel 20, e.g., one or more shapes illustrated in FIGS. 4A and 4B and/or other shapes.

In one form, each of discrete roughness element 34F and 34G is configured with a flow surface 50 and a flow surface 52. Flow surface 50 is configured to provide a more gradual flow area contraction in predominant flow direction 42 than the less gradual flow area contraction in combustion direction 44 provided by flow surface 52, to yield a higher pressure drop in flow in combustion direction 44 than the pressure drop in flow in predominant flow direction 42. The degree of flow area contraction per unit length of each of flow surfaces 50 and 52 may vary with the needs of the application. Flow surfaces 50 and 52 may be planar or may be three-dimensional surfaces. In the depictions of FIGS. 4A and 4B, flow surfaces 52 are bluff surfaces, which present a sudden contraction to flow in combustion direction 44. It will be understood that in other embodiments, flow surface 52 may be configured to yield a gradual contraction to flow in combustion direction 44 in place of a sudden contraction. In various embodiments, other shapes and/or types of discrete roughness elements 34 and/or other means of providing a directionally-dependent pressure loss may be employed in addition to or in place of discrete roughness elements 34F and 34G.

Figure 5A:
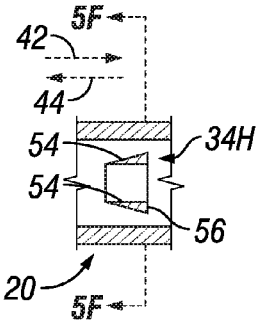
FIGS. 5A-5F schematically illustrate non-limiting examples of discrete roughness elements in accordance with some embodiments of the present invention.
Figure 5B:
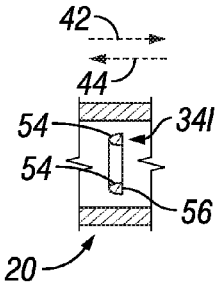
Figure 5C:
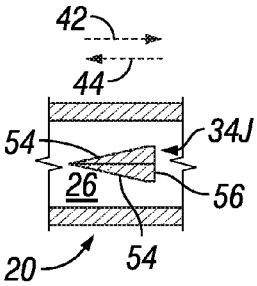
Figure 5D:
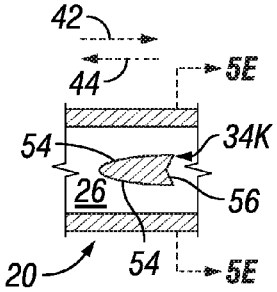
Figure 5E:
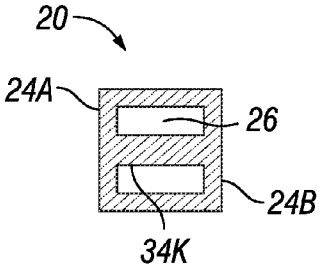
Figure 5F:
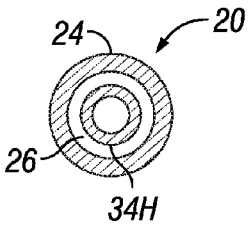

Referring to FIGS. 5A-5E, some non-limiting examples of shapes for discrete roughness element 34 include, but are not limited to, those shapes depicted for discrete roughness elements 34H-34K. The shape of each discrete roughness element 34 may vary with the needs of the application, and is not limited to the depictions of FIGS. 5A-5E. In one form, each discrete roughness element 34 in combustion channel 20 has the same shape. In other embodiments, a plurality of different shapes may be employed in combustion channel 20, e.g., one or more shapes illustrated in FIGS. 5A-5E and/or other shapes. In one form, discrete roughness elements 34H-34K are obstacles disposed in combustion chamber 26. In one form, discrete roughness elements 34H-34K span combustion chamber 26, e.g., as illustrated in FIG. 5E, wherein discrete roughness element 34K spans combustion chamber 26, extending from wall 24A to wall 24B of a rectangular-shaped combustion channel 20 through combustion chamber 26.

In one form, each of discrete roughness elements 34H-34K is configured with a plurality of flow surfaces 54 and a flow surface 56. At least one flow surface 54 is configured to provide a more gradual flow area contraction in predominant flow direction 42 than the less gradual flow area contraction in combustion direction 44 provided by flow surface 56, to yield a higher pressure drop in flow in combustion direction 44 than the pressure drop in flow in predominant flow direction 42.

The degree of flow area contraction per unit length of each of flow surfaces 54 and 56 may vary with the needs of the application. Flow surfaces 54 and 56 may be planar or may be three-dimensional surfaces. In the depictions of FIGS. 5A-5E, flow surfaces 56 are bluff surfaces, which present a sudden contraction to flow in combustion direction 44. It will be understood that in other embodiments, flow surface 56 may be configured to yield a gradual contraction to flow in combustion direction 44 in place of a sudden contraction. In various embodiments, other shapes and/or types of discrete roughness elements 34 and/or other means of providing a directionally-dependent pressure loss may be employed in addition to or in place of discrete roughness elements 34H-34K.

Figure 6A:
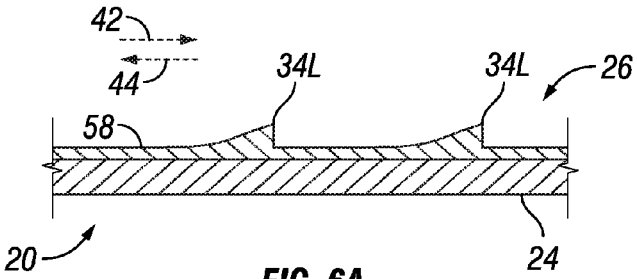
FIGS. 6A and 6B schematically illustrate non-limiting examples of an insert with discrete roughness elements in accordance with some embodiments of the present invention.
Figure 6B:
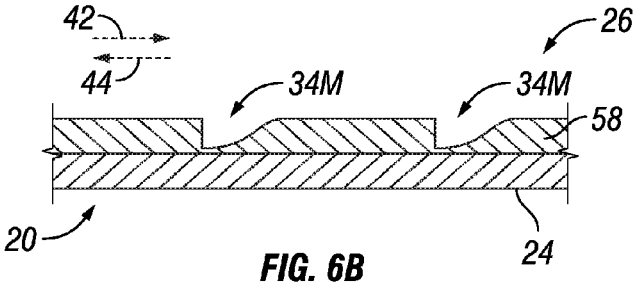

Referring to FIGS. 6A and 6B, non-limiting examples of other embodiments in accordance with the present invention are depicted. In one form, combustion system 14 includes an insert 58 disposed within combustion channel 20 and combustion chamber 26. In one form, one or more discrete roughness elements are formed into, coupled to and/or formed integrally with insert 58. For example, in the depiction of FIG. 6A, insert 58 includes discrete roughness elements 34L, which extend from insert 58 into combustion chamber 26. In the depiction of FIG. 6B, insert 58 includes discrete roughness elements 34M, which are cavities in insert 58 that are exposed to combustion chamber 26. In other embodiments, other shapes and/or types of discrete roughness elements 34 and/or other means of providing a directionally-dependent pressure loss may be employed in addition to or in place of discrete roughness elements 34L and 34M.

Embodiments of the present invention include a combustion system, comprising: a combustion channel configured to contain a combustion process; and a flame accelerator disposed within the combustion channel, wherein the flame accelerator is configured to accelerate the combustion process; and wherein the flame accelerator is configured to yield a directionally-dependent pressure loss in a flow in the combustion channel.

In a refinement, the flame accelerator includes a discrete roughness element having a shape configured to yield the directionally-dependent pressure loss in the flow through the combustion channel; and the discrete roughness element is configured to accelerate the combustion process.

In another refinement, the combustion channel includes at least one wall configured to form a combustion chamber; and the discrete roughness element is a shaped obstacle disposed within the combustion chamber.

In yet another refinement, the discrete roughness element extends from the at least one wall into the combustion chamber.

In still another refinement, the combustion channel includes at least one wall configured to form a combustion chamber; wherein the discrete roughness element is a cavity formed in the at least one wall; and wherein the cavity is exposed to the combustion chamber.

In yet still another refinement, the combustion channel includes at least one wall configured to form a combustion chamber; and the combustion system further comprises an insert disposed in the combustion chamber, wherein the insert includes the discrete roughness element.

In a further refinement, the discrete roughness element is a cavity formed in the insert; and the cavity is exposed to the combustion chamber.

In a yet further refinement, the discrete roughness element extends from the insert into the combustion chamber.

In a still further refinement, the combustion system is configured as a pulse detonation combustor.

In a yet still further refinement, the combustion system is configured as a wave rotor.

Embodiments of the present invention include an engine, comprising: a combustion system, including a flame accelerator configured to interact with and accelerate a combustion process, wherein the flame accelerator is configured to yield a greater flow contraction in a first direction than in a second direction opposite the first direction.

In a refinement, the engine further comprises a combustion channel configured to contain the combustion process, wherein the flame accelerator is disposed within the combustion channel; and wherein the flame accelerator is configured to yield a directionally-dependent pressure loss in a flow in the combustion channel.

In another refinement, the flame accelerator includes a discrete roughness element having a shape configured to yield the directionally-dependent pressure loss in the flow through the combustion channel; and wherein the discrete roughness element is configured to accelerate the combustion process.

In yet another refinement, the engine further comprises a turbine in fluid communication with the combustion system.

In still another refinement, the flame accelerator is structured to transition the combustion process from deflagration combustion to detonation combustion.

In yet still another refinement, the combustion channel has a predominant flow direction and a combustion direction opposite the predominant flow direction; and the shape of the discrete roughness element is configured to yield a higher flow area contraction per unit length in the combustion direction than in the predominant flow direction.

In a further refinement, the shape of the discrete roughness element is configured to yield a sudden contraction in the combustion direction and to yield a gradual contraction in the predominant flow direction.

In a yet further refinement, the combustion channel has a predominant flow direction and a combustion direction opposite the predominant flow direction; and the discrete roughness element is configured to yield a greater pressure drop in the flow in the combustion direction than in the predominant flow direction.

Embodiments of the present invention include an engine, comprising: means for containing a combustion process; and means for accelerating the combustion process, wherein the means for accelerating is disposed in the means for containing, and wherein the means for accelerating is structured to yield a directionally-dependent pressure loss.

In a refinement, the means for accelerating is structured to transition the combustion process from deflagration combustion to detonation combustion.

In another refinement, the means for accelerating is not structured to transition the combustion process from deflagration combustion to detonation combustion.

While the invention has been described in connection with what is presently considered to be the most practical and preferred embodiment, it is to be understood that the invention is not to be limited to the disclosed embodiment(s), but on the contrary, is intended to cover various modifications and equivalent arrangements included within the spirit and scope of the appended claims, which scope is to be accorded the broadest interpretation so as to encompass all such modifications and equivalent structures as permitted under the law. Furthermore it should be understood that while the use of the words "preferable", "preferably", or "preferred" in the description above indicates that feature so described may be more desirable, it nonetheless may not be necessary and any embodiment lacking the same may be contemplated as within the scope of the invention, that scope being defined by the claims that follow. In reading the claims it is intended that when words such as "a," "an," "at least one" and "at least a portion" are used, there is no intention to limit the claim to only one item unless specifically stated to the contrary in the claim. Further, when the language "at least a portion" and/or "a portion" is used the item may include a portion and/or the entire item unless specifically stated to the contrary.

What is claimed is:

1. A combustion system, comprising:

a combustion channel having first and second ends and configured to contain a combustion process;

wherein the combustion channel is configured to introduce combustion fluid proximate the first end and expel combustion fluid proximate the second end;

an igniter disposed downstream of the first end;

wherein the igniter is configured to initiate the combustion process such that a combustion flame front travels from the igniter towards the first end in an opposite direction of a predominant flow direction of the combustible fluid; and a flame accelerator disposed within the combustion channel, wherein the flame accelerator is configured to accelerate the combustion process; and wherein the flame accelerator is configured to yield a directionally-dependent pressure loss in the flow in the combustion channel, wherein the flame accelerator includes a discrete roughness element having a shape configured to yield the directionally-dependent pressure loss in the flow through the combustion channel; and wherein the discrete roughness element is configured to accelerate the combustion process in the opposite direction; wherein the igniter and the discrete roughness element are configured such that the combustion flame front travels upstream toward the first end in the opposite direction past the discrete roughness element.

2. The combustion system of claim 1, wherein the combustion channel includes at least one wall configured to form a combustion chamber; and wherein the discrete roughness element is a shaped obstacle disposed within the combustion chamber.

3. The combustion system of claim 2, wherein the discrete roughness element extends from the at least one wall into the combustion chamber.

4. The combustion system of claim 1, wherein the combustion channel includes at least one wall configured to form a combustion chamber; wherein the discrete roughness element is a cavity formed in the at least one wall; and wherein the cavity is exposed to the combustion chamber.

5. The combustion system of claim 1, wherein the combustion channel includes at least one wall configured to form a combustion chamber, further comprising an insert disposed in the combustion chamber, wherein the insert includes the discrete roughness element.

6. The combustion system of claim 5, wherein the discrete roughness element is a cavity formed in the insert; and wherein the cavity is exposed to the combustion chamber.

7. The combustion system of claim 5, wherein the discrete roughness element extends from the insert into the combustion chamber.

8. The combustion system of claim 1, configured as a pulse detonation combustor.

9. The combustion system of claim 1, configured as a wave rotor.

10. An engine, comprising:

a combustion system having an inlet end and an exit end for a combustible fluid to flow therebetween;

an igniter disposed at the exit end and configured to produce a combustion process that propagates a flame front that travels in a direction opposite to a predominant direction of the flow of the combustible fluid;

a flame accelerator configured to interact with and accelerate the combustion process, wherein the flame accelerator is configured to yield a greater flow contraction in the opposite direction of flow than in the predominant direction of flow, where the flame accelerator includes a discrete roughness element having a shape configured to yield a directionally-dependent pressure loss in the flow through the combustion channel; and wherein the discrete roughness element is configured to accelerate the combustion process in the opposite direction; wherein the igniter and the discrete roughness element are configured such that the combustion flame front travels upstream toward the inlet end in the opposite direction past the discrete roughness element.

11. The engine of claim 10, further comprising a combustion channel configured to contain the combustion process, wherein the flame accelerator is disposed within the combustion channel.

12. The engine of claim 11, wherein the discrete roughness element has a shape configured to yield the directionally-dependent pressure loss in the flow through the combustion channel.

13. The engine of claim 12, wherein the combustion system has the predominant flow direction and the combustion direction opposite the predominant flow direction; and wherein the shape of the discrete roughness element is configured to yield a higher flow area contraction per unit length in the combustion direction than in the predominant flow direction.

14. The engine of claim 13, wherein the shape of the discrete roughness element is configured to yield a sudden contraction in the combustion direction and to yield a gradual contraction in the predominant flow direction.

15. The engine of claim 12, wherein the combustion system has the predominant flow direction and the combustion direction opposite the predominant flow direction; and wherein the discrete roughness element is configured to yield a greater pressure drop in the flow in the combustion direction than in the predominant flow direction.

16. The engine of claim 10, further comprising a turbine in fluid communication with the combustion system.

17. The engine of claim 10, wherein the flame accelerator is structured to transition the combustion process from deflagration combustion to detonation combustion.

18. An engine, comprising:

means for containing a combustion process, wherein the means for containing includes an inlet and an exit;

means for flowing a combustible fluid in a predominant flow direction from the inlet toward the outlet;

an igniter for generating a combustion flame front that travels in an opposite direction to that of the predominant flow direction of the combustible fluid; and a flame accelerator for accelerating the combustion process, wherein the flame accelerator is disposed in the means for containing, and wherein the flame accelerator is structured to yield a directionally-dependent pressure loss; wherein the flame accelerator includes a discrete roughness element having a shape configured to yield the directionally-dependent pressure loss in the flow through the means for containing and wherein the discrete roughness element is configured to accelerate the combustion process in the opposite direction; wherein the igniter and the discrete roughness element are configured such that the combustion flame front travels upstream toward the inlet in the opposite direction past the discrete roughness element.

19. The engine of claim 18, wherein the flame accelerator is structured to transition the combustion process from deflagration combustion to detonation combustion.

20. The engine of claim 18, wherein the flame accelerator is not structured to transition the combustion process from deflagration combustion to detonation combustion.

* * * * *